US005961149A

United States Patent [19]

Hunt

[11] Patent Number: 5,961,149

[45] Date of Patent: Oct. 5, 1999

[54] TOY TRAIN AND BOOK ASSEMBLY

[75] Inventor: Waldo Henley Hunt, Encino, Calif.

[73] Assignee: Intervisual Books, Inc., Santa Monica, Calif.

[21] Appl. No.: 08/976,169

[22] Filed: Nov. 21, 1997

[51] Int. Cl.[6] ..... B42D 1/08

[52] U.S. Cl. ..... 281/22; 105/1.5; 273/286; 273/287; 281/38; 281/51; 446/148

[58] Field of Search ..... 281/38, 51, 22; 446/148–150; 273/285–287; 105/1.5

[56] References Cited

U.S. PATENT DOCUMENTS

| | | | |
|---|---|---|---|
| 1,992,618 | 2/1935 | Jeffreys | 281/38 |
| 2,458,879 | 1/1949 | Schenik | 446/148 |
| 2,544,783 | 3/1951 | Freedman et al. | 281/38 |
| 3,274,706 | 9/1966 | Friend | 434/295 |
| 4,365,438 | 12/1982 | Nelson | 46/202 |
| 4,898,404 | 2/1990 | Babcock | 281/51 |
| 4,937,207 | 6/1990 | Simmell et al. | 446/75 |
| 5,290,190 | 3/1994 | McClanahan | 434/317 |
| 5,707,240 | 1/1998 | Haas et al. | 434/317 |

*Primary Examiner*—Andrea L. Pitts
*Assistant Examiner*—Monica Smith
*Attorney, Agent, or Firm*—Oppenheimer Wolff & Donnelly LLP

[57] ABSTRACT

The covers and flaps of the cover construction of the book and toy assembly are opened and laid flat. Pop-up and fixed structures on the opened cover construction form a village, and a path or track passes through and by the village. The path passes over the front and rear covers, the spine therebetween, and the front and rear flaps folded out from the respective covers. A toy train stored in a storage compartment mounted on the front cover can be removed therefrom by the user, wound up, placed on the track and allowed to run around the track, and thereby through the village. Pressing a button on the inside of the book spine causes a noise making device to emit a train whistle noise to add realism and enjoyment to the train playing experience. Indicia and pictures on the flaps and readable with the covers open and the flaps closed tell a story about the train traveling through the village. When play is completed, the train is returned to its storage compartment, and the cover construction is closed to define a "book," which is stored in a book case or the like.

72 Claims, 8 Drawing Sheets

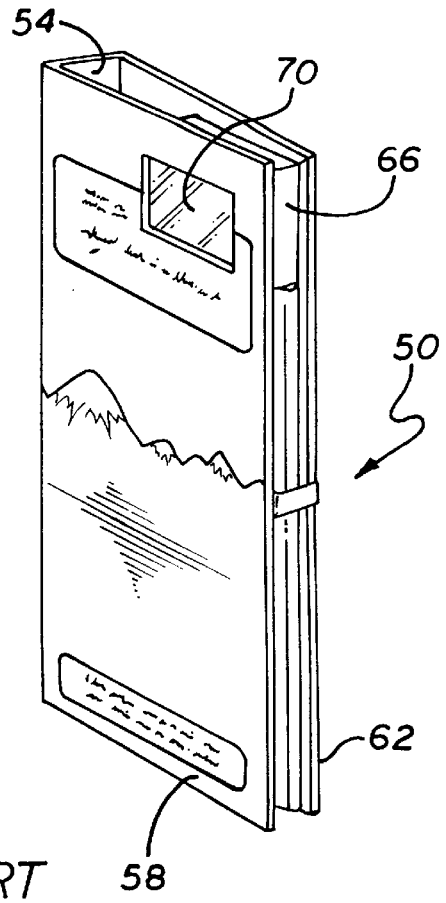
FIG. 1
PRIOR ART
FIG. 2
PRIOR ART
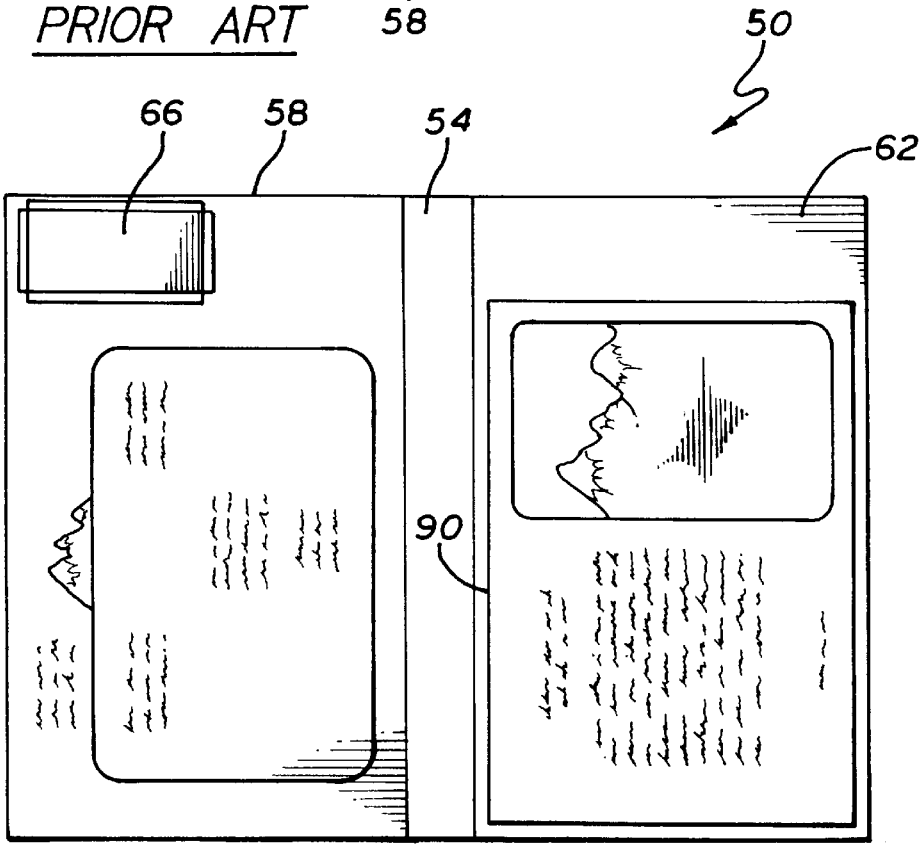

FIG. 3
PRIOR ART
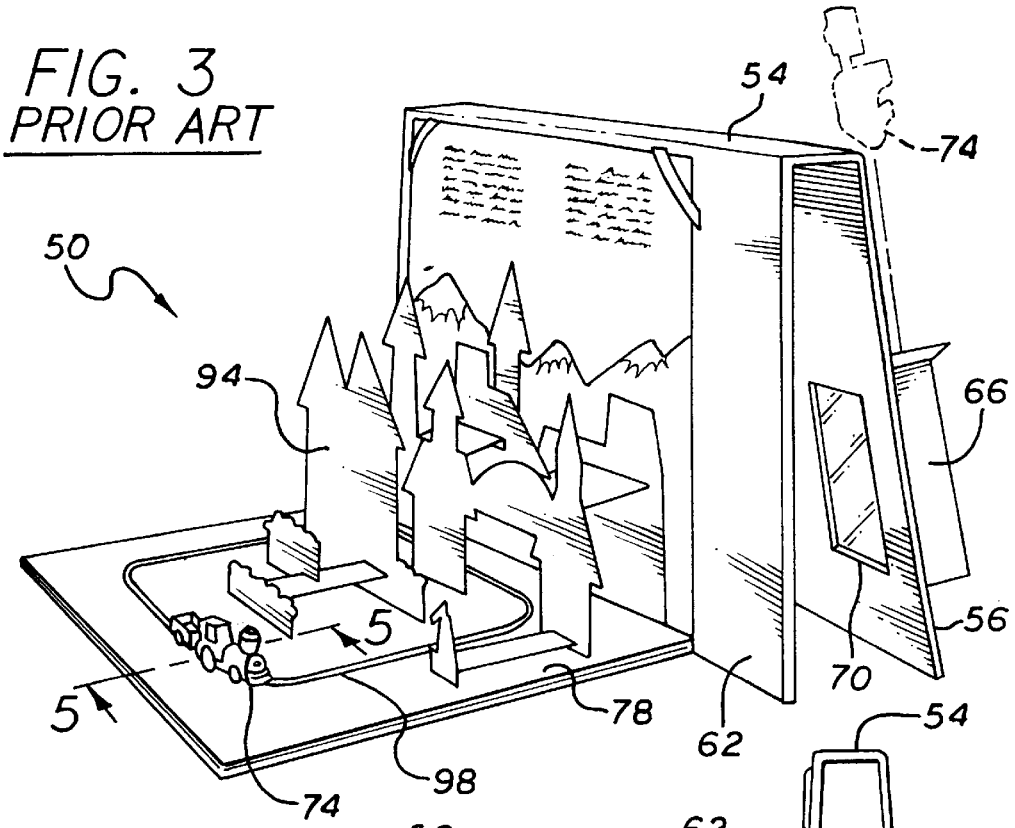
FIG. 4
PRIOR ART
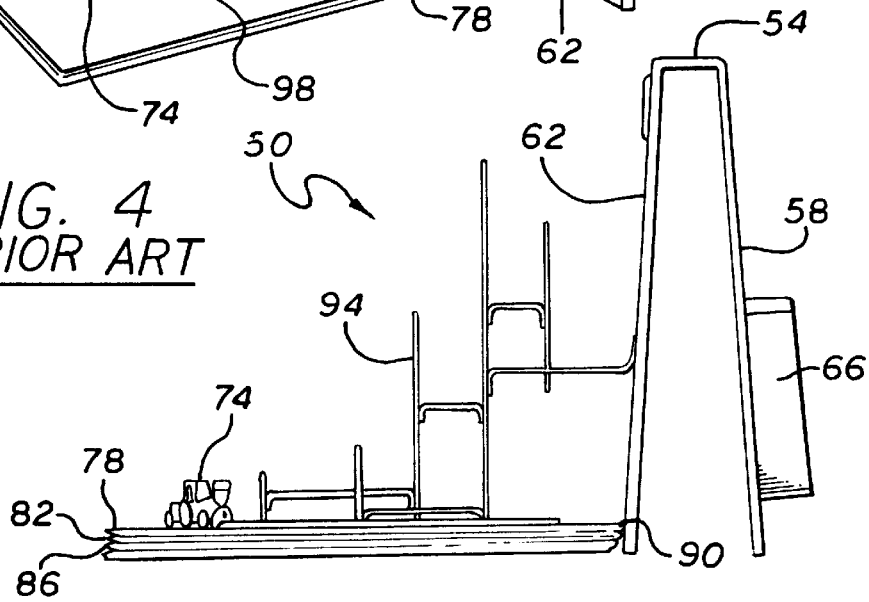
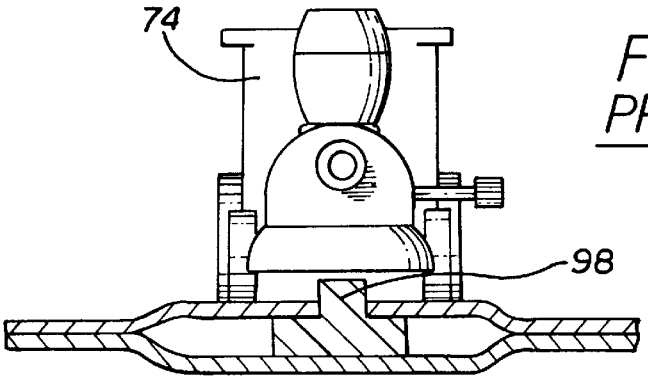
FIG. 5
PRIOR ART FIG. 12
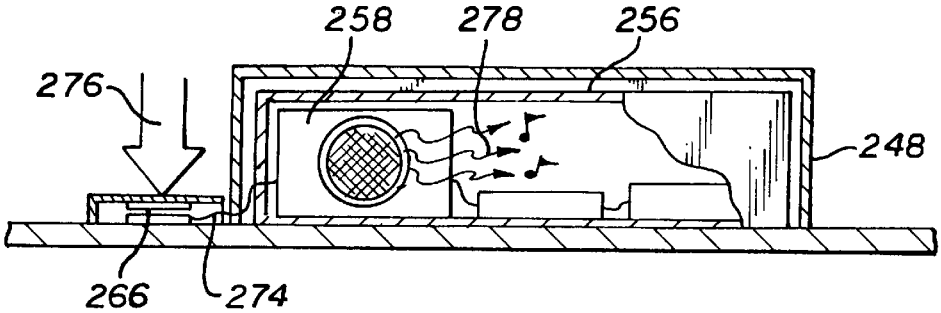
FIG. 13
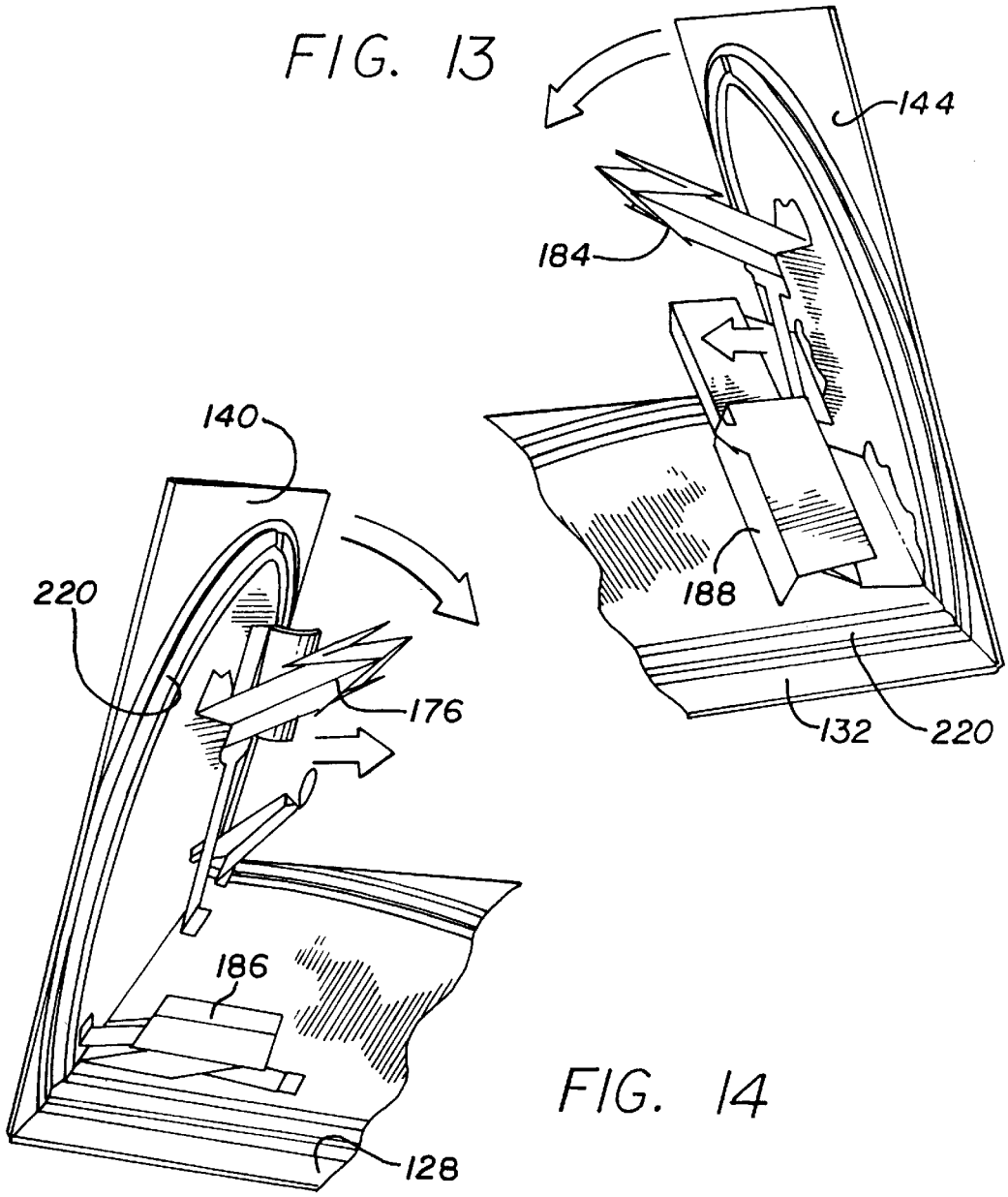
FIG. 14

TOY TRAIN AND BOOK ASSEMBLY

BACKGROUND OF THE INVENTION

The present invention relates to book constructions which can be folded out to define a play area including a travel path for a wind-up toy train or similar object, the train being removable by the user from a storage compartment of the book construction for play along the travel path.

Referring to FIGS. 1–5, a play toy and book assembly of the prior art is shown generally at 50. Assembly 50 includes a book spine 54, and front and rear covers 58, 62 attached thereto on opposite sides thereof. A small storage box 66 is mounted to the front cover 58, and the contents of the box can be viewed through a window 70 in the front cover. When desired, the box 66 can be opened and the play train 74 removed therefrom, as shown by dotted lines in FIG. 3.

FIG. 2 shows the front cover 58 open and the assembly 50 lying flat. A plurality of flaps 78, 82, 86 (FIG. 4) are attached to the right edge 90 of the rear cover 62. Pop-up objects shown generally at 94 are provided between adjacent ones of these flaps. With the covers 58, 62 folded backwards and set up as shown in FIGS. 3 and 4, and one of the flaps 78 folded down, a (first) village formed by the pop-up objects 94 and drawings and decorations on the flaps is formed with a (first) path passing through the village. A (second) different village and path are formed when the second flap is folded down. The objects 94 are buildings, tunnels, trees, animals or people.

A plastic rail 98 embedded in the bottom flap, as best shown in FIGS. 3 and 5, defines a track passing through the village along the path. The toy train 74 when removed from the box 66 and wound up is set on the track over the rail 98 and allowed to run along the track. The track and village are very small, however; the flaps 78 being only approximately 8½ by twelve inches, despite the fact that the book itself when folded up as shown in FIG. 1 is very tall, approximately fifteen inches, unable to stand upright on the shelves of many children's book cases. The child user's imagination and play options are not adequately challenged, with this tiny train play area. Accordingly, this was an unpopular and commercially unsuccessful product.

SUMMARY OF THE INVENTION

Directed to remedying the problems in the prior art, disclosed herein is an improved toy train and book assembly. The book cover construction of this assembly includes front and back covers, a spine therebetween, a front flap connected to the front cover, and a back flap connected to the back cover. With the covers and flaps open and the cover construction lying flat, a large closed loop path is formed thereon. The path traverses over the flaps, covers and spine.

Pop-up structures extend between the front cover and flap, and between the back cover and flap, and pop up to upright positions when the flaps are opened. These pop-up structures depict buildings or other structures of a village, through which a wind-up toy train riding on the path passes. Additional small figures can be removed from an envelope on the cover construction and set up around the village.

The small wind-up toy train is stored in a compartment mounted on the backside of the front cover. A window in the front cover allows the toy train to be viewed when stored in the compartment. When the front flap is closed relative to the front cover, an opening or hole in the front flap fits over the compartment. A closure flap attached to the edge of the opening folds down to cover the opening when the front flap is opened.

The compartment is decorated to resemble a structure, such as a train shed, in the village. Another village structure, decorated to depict a railroad station cafe, is mounted to the spine and houses a noise-making device. When a button adjacent thereto is pushed by the user, the device generates a train whistle noise such as might be emitted by the train as it travels on the path or track through the village. Indicia (words) and pictures telling a story about the train and its travels through the village are printed on the flaps, visible when the covers are open and the flaps closed. After the story has been read and play with the train completed, the train is returned to its storage compartment the small figures are returned to the envelope, the book is folded back to its closed compact condition, and the book then stored in a book case or the like.

Unlike the above-described prior art assembly, the toy train and book assembly of the present invention is much more realistic. The track and village are about four times larger; additional figures and village parts can be assembled as desired by the child user; and additional realism and entertainment are provided by the train whistle which can be actuated whenever desired by the user. In fact, the train set-up closely resembles a small stand alone, small gauge electric train set-up. It has the benefit though of being in a book format with words and a story, to make the play more enjoyable, to further challenge the child's imagination and to increase her interest in reading. Additionally, the train set-up folds up compactly in a book arrangement for easy convenient storage in a bookcase.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 1 is a perspective view of a toy train and book assembly of the prior art illustrated in a closed position;

FIG. 2 is a plan view of the prior art assembly of FIG. 1 in an open reading position;

FIG. 3 is a perspective view of the assembly of FIG. 1 in a folded-out operative position;

FIG. 4 is a side elevational view of the assembly of FIG. 3;

FIG. 5 is an enlarged cross-sectional view taken on line 5—5 of FIG. 3;

FIG. 12 is an enlarged cross-sectional view taken on line 12—12 of FIG. 8 with a portion thereof broken away for illustrative purposes;

FIG. 13 is an enlarged view showing the pop-up structure of the back flap;

FIG. 14 is an enlarged view showing the pop-up structure of the front flap;

DETAILED DESCRIPTION OF PREFERRED EMBODIMENTS OF THE INVENTION

Figure 6:
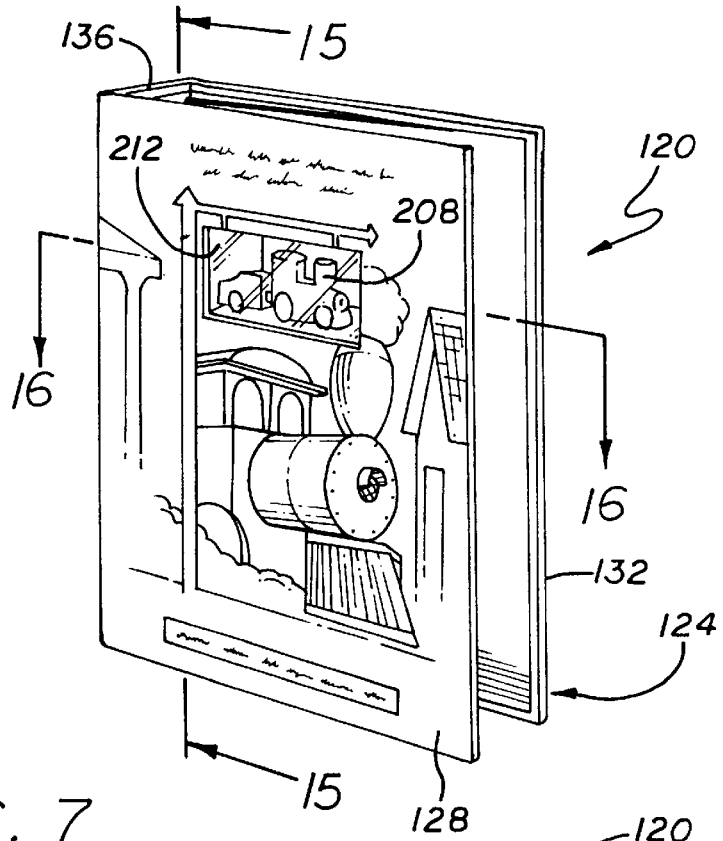
FIG. 6 is a perspective view of a toy train and book assembly of the present invention in a closed position.

A book and toy assembly of the present invention is shown in FIG. 6 generally at 120 in an upright position with a cover construction shown generally at 124 thereof in a closed position. The cover construction 124 includes hard front and rear covers 128, 132 with a hard spine 136 therebetween, and separated at opposite edges thereof from the front and rear covers with fold lines 140, 144, respectively. Titles, descriptors or other indicia can be printed or otherwise provided on the spine 136, readable when the cover construction 124 is in the closed position and upright on a bookshelf, for example. The covers 128, 132 and spine 136 are formed of clipboard panels wrapped or covered with art paper laminated with clear plastic film for gloss and strength. The covers 128, 132 are each approximately 11¼ or 11½ inches high (or long) and nine inches wide. In turn, the spine 136 is approximately 1½ or 1¾ inches wide.

Figure 7:
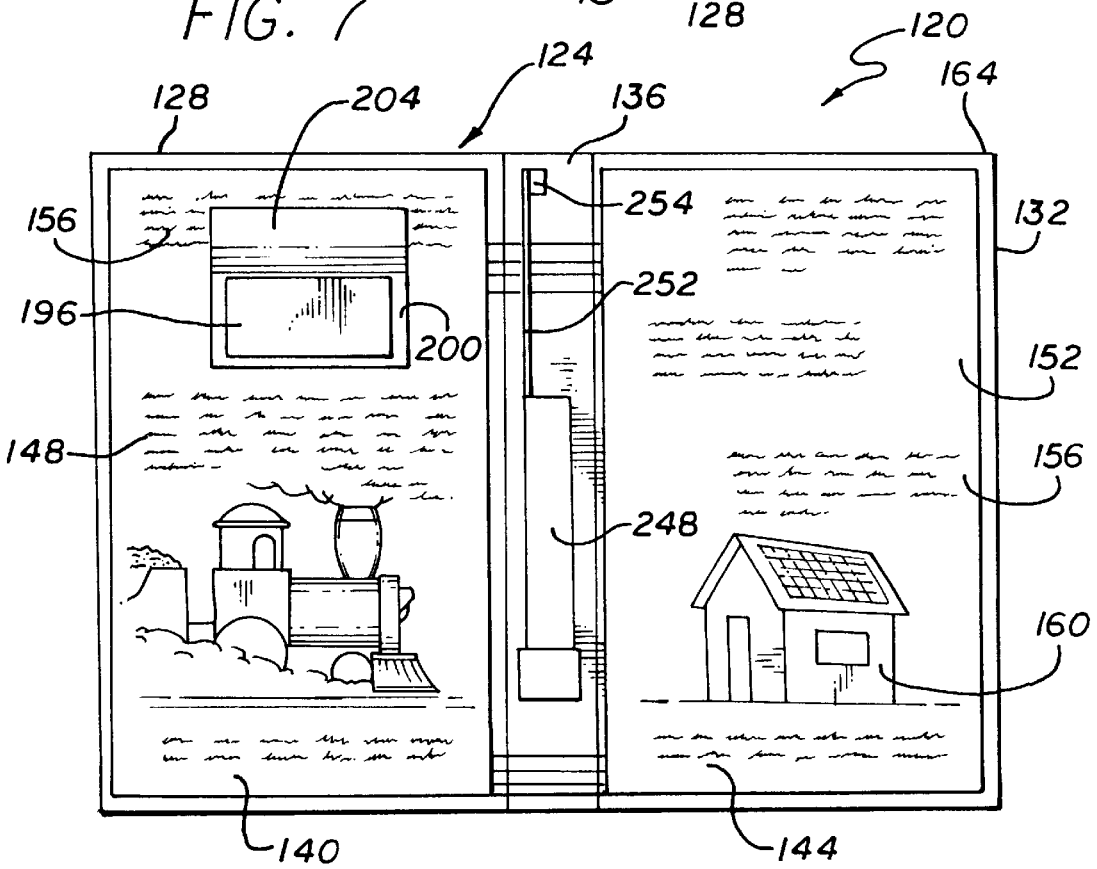
FIG. 7 is a plan view of the assembly of FIG. 6 in an open reading position.

Pivotally attached by the continuous inner base page, at the outside edges of the front and back covers 128, 132 are front and rear flaps 140, 144, are each formed of die cut scored paperboard. With the covers 128, 132 open, the flaps 140, 144 can be moved from closed to open positions. When in the closed positions, the outside sides or faces 148, 152 of the flaps 140, 144, respectively, are on top, as shown in FIG. 7. The words 156 and pictures 160 on the outside faces 148, 152 of the flaps tell a story, which will be discussed later and is depicted generally at 164.

Figure 8:
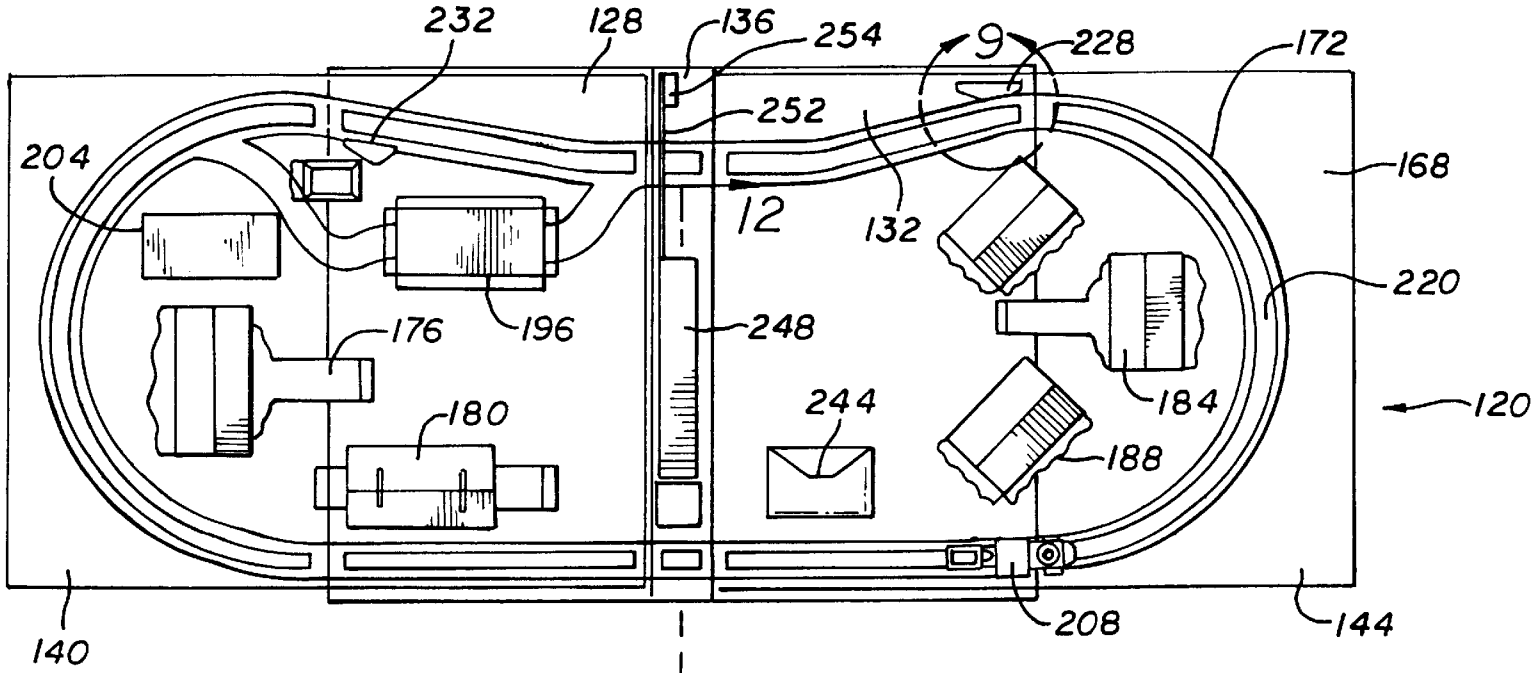
FIG. 8 is a plan view of the assembly of FIG. 6 in a fully open operative position.
Figure 10:
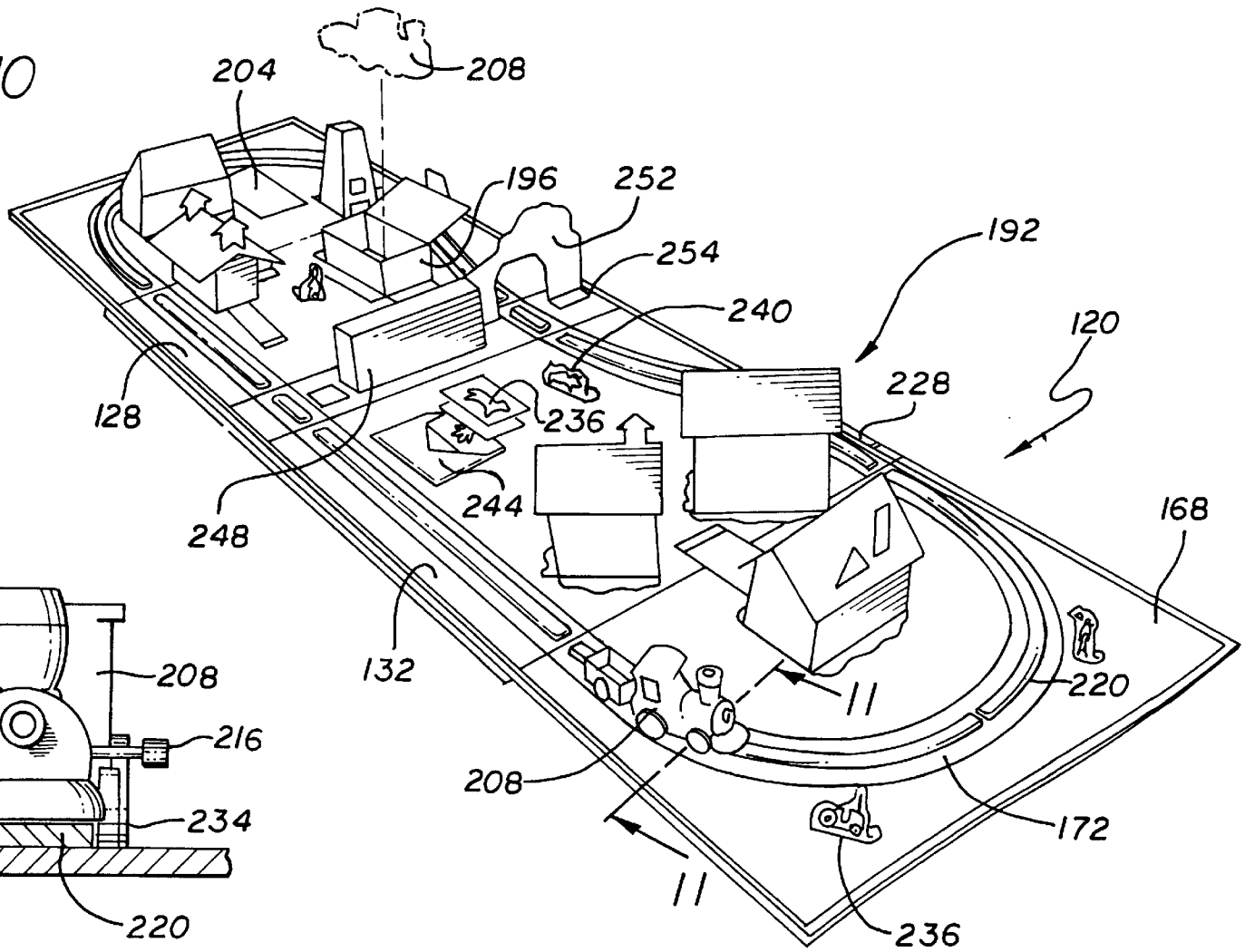
FIG. 10 is a perspective view of the assembly of FIG. 8.

After the story 164 has been read, the flaps 140, 144 can be moved by the user to the flap open positions and the cover construction 124 laid flat open. This is shown in FIGS. 8 and 10. The covers 128, 132, spine 136 and flaps 140, 144 thereby form an elongate board shown generally at 168, approximately 36½ inches long.

Formed on the board 168 is a closed loop path 172, passing over both covers 128, 132 and flaps 140, 144 as well as the spine 136. Pop-up structures 176, 180, 184, 188 extend between the flaps 140, 144 and the adjacent covers 128, 132. They lie flat sandwiched between the respective flap 140, 144 and cover 128, 132 when the flap 140, 144 is in a closed position. When the flap 140 or 144 is opened, they pop-up in a generally known fashion. And when the flap 140 or 144 is subsequently closed, they are drawn together in a flat orientation as can be understood from FIGS. 13 and 14.

Figure 16:
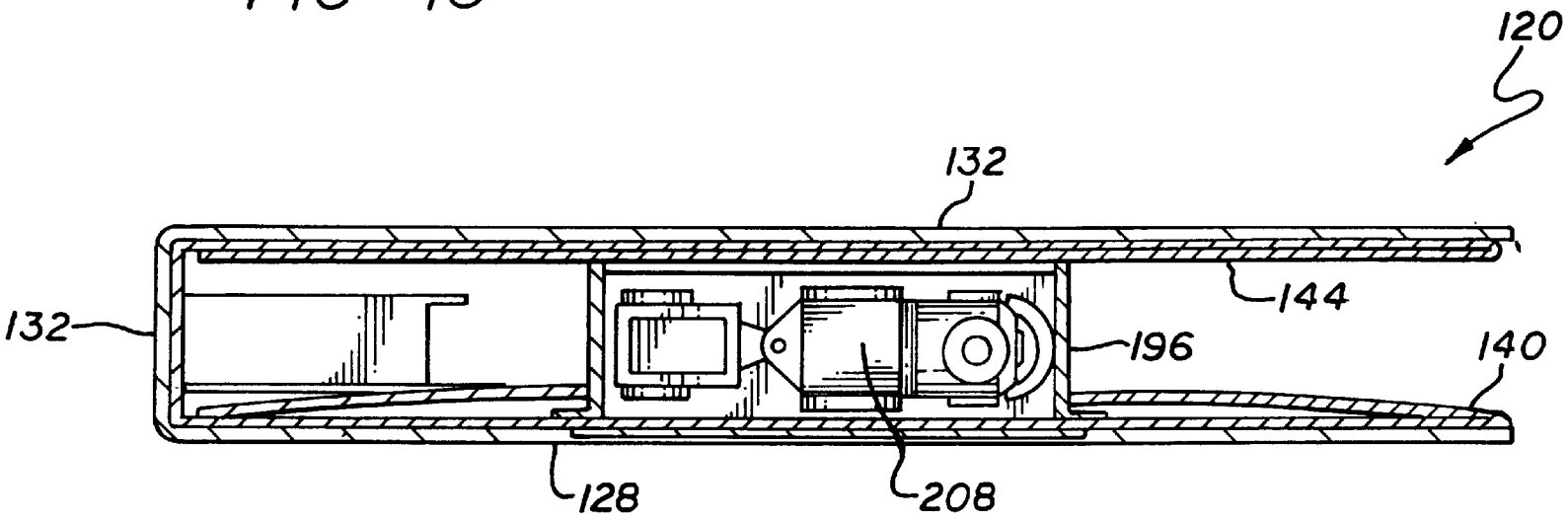
FIG. 16 is an enlarged cross-sectional view taken on line 16—16 of FIG. 6.

With the flaps 140, 144 in an open position, the pop-up structures 176, 180, 184, 188 define part of a village (or other three dimensional scenery or stage) shown generally at 192 on the board 68 around and through which the path 172 passes. Another building or other structure in the village 192 is defined by a box-shaped structure 196 mounted to the backside of the front cover 128 and extending out therefrom. This structure 196 can be decorated to depict a train shed, for example, in the village 192 with the path, but not the track itself, shown leading up to it and exiting from it. It is a generally rigid structure; that is, it does not collapse or otherwise fold up when the front flap 140 and cover 128 are closed. Rather, it is upright, generally spacing the two covers 128, 132 apart when they are closed, as shown in FIG. 16, and has a height which is generally or a little less than the width of the spine 136.

The front flap 140 has a rectangular hole 200 as can be seen in FIGS. 7 and 14, for example, and a cover flap 204 attached to an edge of the hole. When the front flap 140 is in a closed position, the box-shaped structure 196 protrudes up through the hole 200 as depicted in FIG. 7 and the cover flap 204 is in a folded open position. When the front flap 140 is open, as illustrated in FIGS. 8 and 10, the cover flap 204 is moved to a closed position to cover the hole 200.

The wind-up toy train (or similar object) 208 is stored in this box-shaped structure 196. The train 208 can be accessed and removed from the box 196 by opening a box end or top and the train removed therefrom as shown by the dotted line representation in FIG. 10. A plastic window 212 mounted in the front cover 128 defines the front of the box 196. Thereby the train 208 when stored in the box 196 can be viewed from and through the front cover 128, as shown in FIG. 6. This increases the appeal of the assembly 120 to the purchaser and the user. It also helps them to quickly identify the use of the assembly 120. It further is an easy double check that the train 208 has been returned to a storage condition in the assembly 120.

Figure 9:
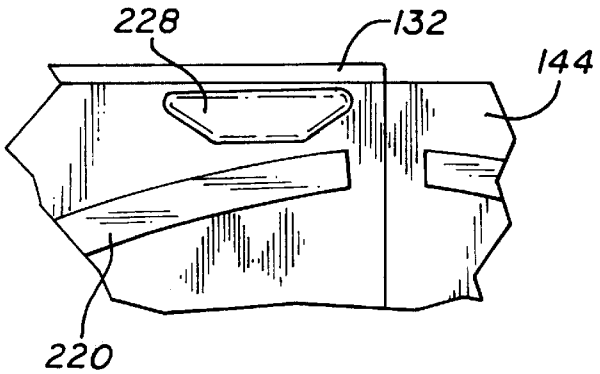
FIG. 9 is an enlarged view taken on circle 9—9 of FIG. 8.
Figure 11:
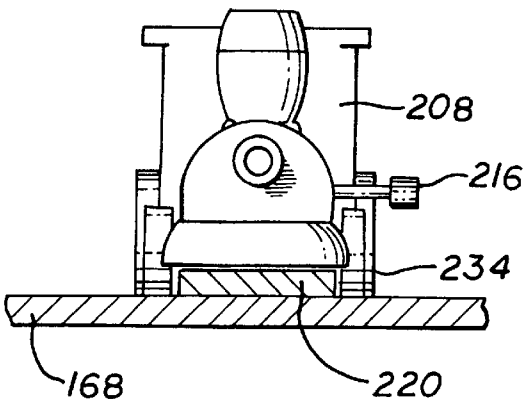
FIG. 11 is an enlarged cross-sectional view taken on line 11—11 of FIG. 10.
Figure 15:
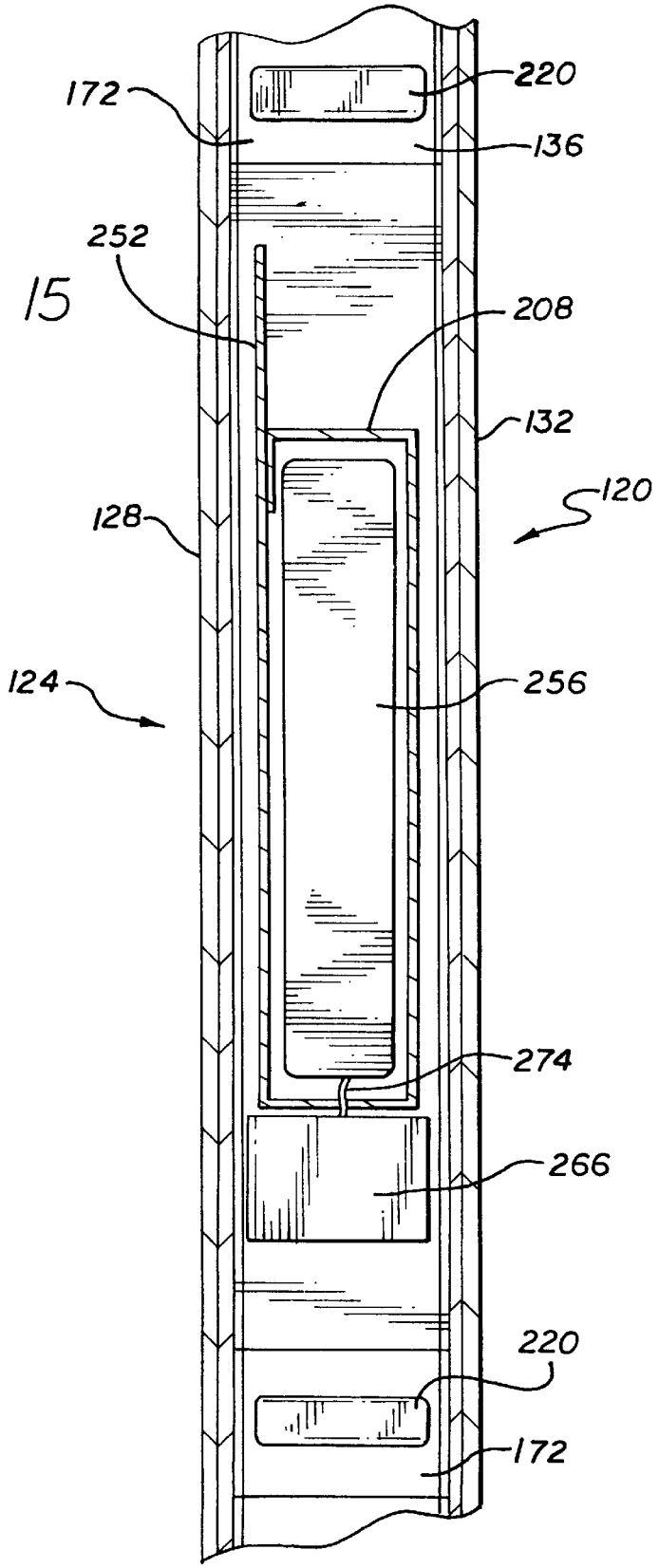
FIG. 15 is an enlarged cross-sectional view taken on line 15—15 of FIG. 6.

The train 208 is a wind-up type of toy train. By turning the outwardly extending post 216 (FIG. 11) between the user's thumb and finger(s) in a known manner the train is wound up. Then it is placed on the raised track 220 formed on the board in the path 172 with the wheels 224 straddling the track 220, and the post 216 and train 208 released and the train rides along the path 172 guided by the raised track 220. The track 220 is formed of chip board in order to facilitate movement of the train past the fold lines of the assembly. For ease of manufacture, the chip board track may be glued to the base page, avoiding complex securing arrangements employed in prior art construction. Outboard or inboard of one or more of the curves on the track are raised guides or bumps 228, 232, as best shown in FIG. 9. The guides 228, 232 are spaced outboard or inboard a distance from the track 220 so that the train wheels 234 can pass therebetween.

To increase the realism of the village 192, additional (two-dimensional) figures and objects 236, 240 are provided stored in an envelope 244 secured on the board 168, and more particularly to rear cover 132. The user removes them from the envelope 244, punches them out and sets them up on the board 168 as desired to supplement the other village structures. These figures and objects 236 and 200 can be inserted into pre-existing slots on the board 168 or can be set up wherever desired by the user on the board. They can also be repositioned as desired by the user during the play period. For example, they can be repositioned to follow the story line of the story 164 printed on the flaps 140, 144 (and covers 128, 132). Or they can be repositioned as desired by the child user's imagination.

Another box-like structure 248 of the village 192 is mounted on the inside surface of the spine 136. It is a fixed non-collapsible structure decorated and labeled to depict a railroad cafe, for example. A bridge, tunnel or overpass 252 can extend out from the structure 248, extending over the track 220 and attached to the board 168, or more particularly the spine 136 on the opposite side of the track 220 by tab 254, but spaced above the track so as to not obstruct or block the passage of the train 208 therethrough. The structure 248 houses in a plastic case 256 a noise making device 258, which includes a speaker, a voice chip, PC board and an activation switch or button 266; as shown in FIG. 12; and provides simulated train noises. The device 258 can be connected to an actuator button 266, mounted on the spine 136 outside of and directly adjacent the structure 248 and connected thereto with an electric wire 274.

Then as shown in FIG. 12, when the user presses down (as shown by the arrow 276 in FIG. 12) on the button 266, the device 258 is actuated and a noise 278 is generated and emitted therefrom. The noise 278 preferably mimics or resembles that of a train whistle. This markedly increases the fun value of play with the present invention compared with the previously-described prior art assembly 50. Thereby, the user, often a child (three years and older), presses the button 266 to sound the whistle as the train 208 travels through the village 192, increasing the realism of the play.

The assembly 120 of the invention is a multi-faceted, multi-dimensional and multi-sensory play experience. The child reads the story 164 or has it read to her. And then she gets to experience the story 164 in three dimensions with motion and sound. He can build or change the village 192 as desired. Thereby the invention utilizes and exercises his visual, auditory, mechanical, mental and creativity skills. He also learns to better appreciate reading as he fully experiences the story, while having fun. When play is completed, the play figures or objects 236, 240 are returned to the envelope 244, the toy train 208 is returned to its compartment 196, the flaps 140, 144 are folded in and the covers 128, 132 closed. Thereby a compact book shaped "package" is formed with all of the "pieces" secured away and the "book" ready for easy, neat and convenient storage in the child's bookcase with her other books. The stored "book" (assembly 120) is thereby accessible and ready for further reading and play at a later time.

Another embodiment of this invention is for the wind-up toy to be configured like a barnyard animal, such as a duck with wheels perhaps configured to resemble duck feet. Instead of a village, a barnyard is formed and the pop-up structures can be a barn, a fence, a horse, a farmer, a silo or other barnyard objects, and the accessory figures can be other farm animals and/or farm people. Then when the toy duck is removed from the storage compartment, wound-up and set on the track, he travels along the track through the barnyard. The sound making device can make a quacking sound. And the story printed on the cover and flaps can recount the adventures in the life of a barnyard duck. Alternatively, to appeal to many young boys the toy can be a military vehicle and the "village" can be a war zone.

From the foregoing detailed description, it will be evident that there are a number of additional changes, adaptations and modifications of the present invention which come within the province of those skilled in the art. For example, more than one toy can be provided and/or more than one track can be formed when the cover construction is opened up. However, it is intended that all such variations not departing from the spirit of the invention be considered as within the scope thereof as limited solely by the claims appended hereto.

What is claimed is:

1. A book assembly, comprising:

a cover construction positionable in alternative open and closed positions, said cover construction including a storage compartment;

a path defined with said cover construction in the open position; and an object positionable in a stored condition in said storage compartment and in an alternative removed condition, removed from said storage compartment, said object when in the removed condition being positionable on and movable along said path;

wherein said cover construction includes a front cover, a back cover and a flap pivotally connected to one of said front and back covers and pivotal out therefrom from a closed position to an open position, and with said cover construction and said flap in their open positions, said path is formed at least on said front and back covers and on said flap.

2. The book assembly of claim 1 further comprising a pop-up structure spanning between said flap and said front or back cover pivotally connected thereto and in a folded-down condition with said flap in a closed position and in a raised position with said flap in the open position.

3. The book assembly of claim 1 wherein said compartment is mounted to said front or back cover to which said flap is connected, and said flap includes an opening in which said compartment is disposed with said flap in a closed position.

4. The book assembly of claim 3 wherein said flap includes an opening-cover flap which with said flap in an open position generally covers said opening.

5. The book assembly of claim 1 wherein said flap defines a first flap, and said cover construction includes a second flap pivotally connected to the other of said front and back covers and pivotal out therefrom to an open position.

6. The book assembly of claim 5 wherein said first and second flaps are pivotal to their respective open positions in opposite directions.

7. The book assembly of claim 5 wherein a portion of said path is on said second flap when in the open position.

8. The book assembly of claim 1 wherein said cover construction includes a spine between said front and back covers, and a portion of said path is on said spine when said cover construction is in the open position.

9. The book assembly of claim 8 further comprising a sound producing mechanism mounted on said spine, and sandwiched between said front and back covers with said cover construction in the closed position.

10. The book assembly of claim 1 wherein said cover construction includes a guide track, which guides said object along said path.

11. A book assembly, comprising:

a cover construction positionable in alternative open and closed positions, said cover construction including a storage compartment;

a path defined with said cover construction in the open position; and an object positionable in a stored condition in said storage compartment and in an alternative removed condition, removed from said storage compartment, said object when in the removed condition being positionable on and movable along said path;

wherein said cover construction includes a front cover and a rear cover, and a first portion of said path is on said front cover and a second portion of said path is on said rear cover.

12. The book assembly of claim 11 wherein said cover construction includes indicia telling a story concerning said object traveling along said path.

13. The book assembly of claim 12 wherein said cover construction includes a first flap attached to said front cover and a second flap attached to said rear cover, and a first portion of said indicia is on said first flap and a second portion of said indicia is on said second flap.

14. The book assembly of claim 13 wherein a third portion of said path is on said first flap, and a fourth portion of said path is on said second flap.

15. The book assembly of claim 14 wherein said third portion of said path and said first portion of said indicia are on opposite sides of said first flap, and said fourth portion of said path and said second portion of said indicia are on opposite sides of said second flap.

16. The assembly of claim 12 wherein said path includes a raised guide track.

17. The book assembly of claim 16 wherein said object includes spaced wheels positionable on opposite sides of said raised guide track and thereby guided along said path when moving therealong.

18. A book assembly, comprising:

a cover construction positionable in alternative open and closed positions, said cover construction including a storage compartment;

a path defined with said cover construction in the open position;

an object positionable in a stored condition in said storage compartment and in an alternative removed condition, removed from said storage compartment, said object when in the removed condition being positionable on and movable along said path; and a sound making device supported by said cover construction;

wherein said cover construction includes a spine between said front and back covers, and said sound making device is mounted on an inside surface of said spine, disposed between said front and back covers.

19. The book assembly of claim 18 wherein said path includes a raised guide track.

20. The book assembly of claim 19 wherein said object includes spaced wheels positionable on opposite sides of said raised guide track and thereby guided along said path when moving therealong.

21. The book assembly of claim 18 wherein said sound making device is user activated.

22. The book assembly of claim 18 wherein said sound making device includes a user-activated mechanism attached to said cover construction.

23. The book assembly of claim 22 wherein said user-activated mechanism is a push button mounted on the inside surface of said spine.

24. The book assembly of claim 18 wherein said sound making device makes a noise associated with said object.

25. The book assembly of claim 18 wherein said object resembles a vehicle and said noise resembles a vehicular noise.

26. The book assembly of claim 25 wherein said vehicle is a train and said vehicular noise is a train whistle.

27. A book assembly, comprising:

a cover construction positionable in alternative open and closed positions, said cover construction including a storage compartment;

a path defined with said cover construction in the open position; and an object positionable in a stored condition in said storage compartment and in an alternative removed condition, removed from said storage compartment, said object when in the removed condition being positionable on and movable along said path;

wherein said cover construction includes a spine and structure mounted to said spine and with said cover construction in the open position, said structure forming an opening through which said object passes when traveling on said path.

28. The book assembly of claim 27 wherein said structure defines a bridge.

29. The book assembly of claim 27 wherein said structure defines a tunnel.

30. The book assembly of claim 27 wherein said object comprises a self-propelled vehicle.

31. The book assembly of claim 27 wherein said cover construction includes at least one pop-up structure associated with said path.

32. The book assembly of claim 27 wherein said path includes a raised guide track.

33. The book assembly of claim 32 wherein said object includes spaced wheels positionable on opposite sides of said raised guide track and thereby guided along said path when moving therealong.

34. A book assembly, comprising:

a cover construction positionable in alternative open and closed positions, said cover construction including a storage compartment;

a path defined with said cover construction in the open position; and an object positionable in a stored condition in said storage compartment and in an alternative removed condition, removed from said storage compartment, said object when in the removed condition being positionable on and movable along said path;

wherein said cover construction includes a first flap secured to said front cover and pivotal relative thereto between open and closed positions, said front flap having an opening, and said compartment extending through said opening when said front flap is in the closed position.

35. The book assembly of claim 34 wherein said cover construction when in the open position defines a village through which said path traverses, and said compartment defines a defined-object in said village.

36. The book assembly of claim 35 wherein said object is a train and said defined-object is a train-related structure.

37. The book assembly of claim 34 wherein said compartment is secured to said front cover and includes a window in said front cover through which said object when in said compartment is displayed.

38. The book assembly of claim 34 wherein said first flap when in the open position defines a portion of said path.

39. A book assembly, comprising:

a cover construction positionable in alternative open and closed positions, said cover construction including a storage compartment;

a path defined with said cover construction in the open position; and an object positionable in a stored condition in said storage compartment and in an alternative removed condition, removed from said storage compartment, said object when in the removed condition being positionable on and movable along said path;

wherein said object includes spaced wheels and said path has a raised track portion, said spaced wheels being positionable on opposite sides of said raised track portion and thereby guided along said path when moving therealong; and wherein said path has a curved portion, and said cover construction includes a guiding structure spaced out from said raised track portion to guide said object relative to said curved portion.

40. The book assembly of claim 39 wherein said raised portion comprises a chipboard track.

41. The book assembly of claim 39 wherein said object is self-propelled along said path.

42. The book assembly of claim 39 wherein said path forms a closed loop, and said raised track portion is at least substantially continuous about the entire extent of said closed loop.

43. The book assembly of claim 42 wherein said raised portion is broken at fold lines of said cover construction.

44. A book assembly, comprising:

a cover construction positionable in alternative open and closed positions, said cover construction including a storage compartment;

a path defined with said cover construction in the open position; and an object positionable in a stored condition in said storage compartment and in an alternative removed condition, removed from said storage compartment, said object when in the removed condition being positionable on and movable along said path;

wherein said cover construction includes front and rear covers, a spine between said front and rear covers, a sound making device and a sound making compartment housing said sound making device and mounted on said spine; and wherein said spine, said sound making compartment and said storage compartment space said front and rear covers in generally parallel relation when said cover construction is in the closed position.

45. The book assembly of claim 44 wherein said sound making compartment is sandwiched between said front and rear covers with said front and rear covers in closed positions.

46. The book assembly of claim 45 wherein said cover construction includes a spine between said front and back covers, and said sound making device is mounted on an inside surface of said spine, disposed between said front and back covers.

47. The book assembly of claim 45 wherein said sound making device makes a noise associated with said object.

48. The book assembly of claim 45 wherein said object resembles a vehicle and said noise resembles a vehicular noise of said vehicle.

49. The book assembly of claim 48 wherein said vehicle is a train and said vehicular noise is a train whistle.

50. A book assembly, comprising:

a cover construction positionable in alternative open and closed positions, said cover construction including a storage compartment;

a path defined with said cover construction in the open position; and an object positionable in a stored condition in said storage compartment and in an alternative removed condition, removed from said storage compartment, said object when in the removed condition being positionable on and movable along said path;

wherein said cover construction include a front cover, a rear cover and a spine therebetween, and said path traverses over said front and rear covers and said spine; and wherein said object includes spaced wheels, said path includes a raised track portion which guides said object with said spaced wheels on opposite sides thereof, and said raised track portion is discontinuous at a first fold line separating said front cover and said spine and at a second fold line separating said rear cover and said spine.

51. The book assembly of claim 50 wherein said path encircles said object compartment.

52. A play method, comprising the steps of:

(a) providing a book assembly including a book cover construction, a compartment mounted to the cover construction, and a toy stored in the compartment;

(b) opening the cover construction so as to thereby define a path thereon;

(c) removing the toy from the compartment; and (d) causing the removed toy to move along the path;

wherein the book cover construction includes front and rear covers and front and rear flaps, and said opening step includes causing the covers and flaps to lie flat and the path thereby traversing over both of the covers and at least one of the flaps.

53. The method of claim 52 wherein the book cover construction includes indicia on the flaps telling a story concerning the toy or pop-up structures supported on the book cover construction, and further comprising (e) reading the story with the covers open and the flaps closed.

54. The method of claim 52 wherein said opening causes pop-up structures between the covers and the flaps to pop up adjacent to the path.

55. The method of claim 52 further comprising activating a sound emitting device carried by the cover construction.

56. The method of claim 55 wherein said activating includes manipulating an actuator mounted on an inside surface of a spine of the cover construction.

57. The method of claim 52 wherein the path includes a closed loop track, and step (d) includes winding up the removed toy and releasing the wound up toy to travel along the closed loop track.

58. A book assembly, comprising:

a cover construction positionable in alternative open and closed positions, said cover construction including a storage compartment;

a path defined with said cover construction in the open position; and an object positionable in a stored condition in said storage compartment and in an alternative removed condition, removed from said storage compartment, said object when in the removed condition being positionable on and movable along said path;

wherein said cover construction includes a front cover, a back cover and a flap pivotally connected to said back cover and pivotal relative thereto from a closed position to an open position, and with said cover construction and said flap in their open positions, a first portion of said path is formed on said back cover and a second portion of said path is formed on said flap.

59. The book assembly of claim 58 wherein a third portion of said path is on said cover construction but not on either of said back cover or said flap.

60. The book assembly of claim 58 wherein said front cover includes a window through which the object can be viewed when the object is in the stored condition and the cover construction is in the closed position.

61. The book assembly of claim 58 further comprising a pop-up structure spanning between said flap and said back cover, said pop-up structure being in a folded-down condition with said flap in a closed position and in a raised position with said flap in the open position.

62. The book assembly of claim 58 wherein said cover construction includes a guide track which guides said object along said path.

63. The book assembly of claim 58 further comprising an envelope secured to said cover construction proximate to said path and enclosing play figures removable therefrom.

64. The book assembly of claim 58 wherein said cover construction includes a spine, a first fold line separating said spine from said front cover and a second fold line separating said spine from said rear cover, said second fold line being spaced a distance from said first fold line.

65. The book assembly of claim 58 wherein said front cover, said back cover and said flap lie flat when in the respective open positions.

66. A book assembly, comprising:

a cover construction positionable in alternative open and closed positions, said cover construction including a storage compartment;

a path defined with said cover construction in the open position; and an object positionable in a stored condition in said storage compartment and in an alternative removed condition, removed from said storage compartment, said object when in the removed condition being positionable on and movable along said path;

wherein said cover construction includes a front cover, a back cover and a layer sheet, said layer sheet having a fold line dividing said layer sheet into first and second layer sheet portions, said first layer sheet portion being secured to and on said back cover, said second layer sheet portion forming a flap pivotal about said fold line between open and closed positions relative to said back cover, a first portion of said path being formed on said first layer sheet portion with said cover construction in the open position, and a second portion of said path being formed on said second layer sheet portion with said flap in the open position.

67. The book assembly of claim 66 wherein said front cover includes a window through which the object can be viewed when the object is in the stored condition and the cover construction is in the closed position.

68. The book assembly of claim 66 further comprising a pop-up structure spanning between said flap to said back cover, said pop-up structure being in a folded-down condition with said flap in a closed position and in a raised position with said flap in the open position.

69. The book assembly of claim 66 wherein said cover construction includes a guide track which guides said object along said path.

70. The book assembly of claim 66 further comprising an envelope secured to said cover construction and proximate to said path and enclosing play figures.

71. The book assembly of claim 66 wherein said cover construction includes a spine, a first fold line separating said spine from said front cover and a second fold line separating said spine from said rear cover, said second fold line being spaced a distance from said first fold line.

72. The book assembly of claim 66 wherein said front cover, said back cover and said flap lie flat when in the respective open positions.

* * * * *